United States Patent [19]

Kobayashi

[11] Patent Number: 4,854,580

[45] Date of Patent: Aug. 8, 1989

[54] GOLF CLUB

[75] Inventor: Kenji Kobayashi, Niigata, Japan

[73] Assignee: Endo Manufacturing Co., Ltd., Japan

[21] Appl. No.: 156,899

[22] Filed: Feb. 17, 1988

[30] Foreign Application Priority Data

Sep. 22, 1987 [JP] Japan ..... 62-237670

[51] Int. Cl.[4] ..... A63B 53/04

[52] U.S. Cl. ..... 273/77 A; 273/167 A

[58] Field of Search ... 273/77 A, 77 R, 167 A–167 K, 273/167 R, 169, 170–175; D21/214, 216

[56] References Cited

U.S. PATENT DOCUMENTS

| | | | |
|---|---|---|---|
| 1,945,844 | 3/1934 | Young | 273/174 |
| 3,088,736 | 5/1963 | Mospan | 273/167 A |
| 3,897,065 | 7/1975 | Solheim | 273/167 A |
| 4,645,207 | 3/1987 | Teramoto et al. | 273/77 A |
| 4,754,969 | 7/1988 | Kobayashi | 273/77 A |

FOREIGN PATENT DOCUMENTS

| | | | |
|---|---|---|---|
| 385660 | of 1933 | United Kingdom | 273/77 A |
| 2170719A | of 1986 | United Kingdom | 273/77 A |
| 2179262 | of 1987 | United Kingdom | 273/77 A |

*Primary Examiner*—Edward M. Coven
*Assistant Examiner*—S. Passaniti
*Attorney, Agent, or Firm*—Steele, Gould & Fried

[57] ABSTRACT

A set of golf clubs, has irons with their loft angles decreasing inversely proportionately to the lengths of shafts and their grounding edges formed on their soles such that they are swept back or regressed inversely proportionately to the lengths of the shafts. Thus, the longer irons for hitting up the ball are allowed to have their faces confront the ball accurately, and the shorter irons for hitting down the ball are allowed to have their faces hit it through.

3 Claims, 3 Drawing Sheets

GOLF CLUB

BACKGROUND OF THE INVENTION

1. Field of the Invention

The present invention relates to a golf club and, more particularly, to a structure of the clubhead designed to improve the hitting feel of the "irons".

2. Description of the Prior Art

One representative of the golf club of the prior art is disclosed in U.S. Pat. No. 3,995,865. The golf club disclosed is formed on its front side with a face providing a ball hitting surface and on its bottom with a flat sole. The construction of the golf club is completed by connecting a shaft to the neck or hosel.

In shorter irons such as Nos. 8 and 9 clubs, the conventional clubhead having the flat sole will make the golf player feel difficult to hit through the ball and is accordingly accompanied by the problem of the "poor through feel". With the shorter irons, specifically, the player will make a swing to hit down the ball with such a smaller radius of gyration as to spin the ball. With the flat sole described above, the resultant weak reaction of the ground would cause the swung clubhead to be dragged by the turf so that the hitting speed would drop. With longer irons such as Nos. 3 and 4 clubs, on the other hand, the player will make a swing to hit up the ball with such a larger radius of gyration as to hit it away. This "hitting up" swing will not need any strong reaction of the shorter irons from the ground but should make the clubface front impinge upon the ball. This makes it desirable to position the lower edge of the clubface as low as possible.

SUMMARY OF THE INVENTION

It is, therefore, an object of the present invention to provide a set of golf clubs, of which the shorter irons are allowed to hit through the ball with less drag whereas the longer irons are allowed to position the lower edges of the clubfaces as low as possible to confront the ball accurately.

According to a major feature of the present invention, there is provided a set of golf clubs, of which the irons have their loft angles decreasing inversely proportionately to the lengths of shafts and their grounding edges formed on their soles such that they are swept back or regressed inversely proportionately to the lengths of the shafts.

BRIEF DESCRIPTION OF THE DRAWINGS

Other objects, features and advantages of the present invention will become apparent from the following description taken with reference to the accompanying drawings, in which:

FIGS. 1 and 2 show a first embodiment of the present invention, in which

DESCRIPTION OF THE PREFERRED EMBODIMENTS

The present invention will be described in the following in connection with its first embodiment with reference to FIGS. 1 and 2.

Figure 1A:
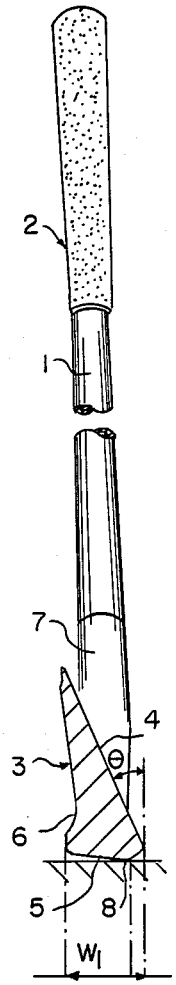
FIGS. 1(A) to 1(G) are sections showing Nos. 3 to 9 irons

FIGS. 1(A) shows a No. 3 iron 2 which has a shaft 1 of a predetermined length. The iron 2 has its head 3 formed on its front side with a face 4 having a predetermined loft angle $\theta$ and on its bottom with a sole 5. On the back of the clubhead 3, there is formed a balancing recess 6 for adjusting the centroid (or center of mass) of the clubhead 3. At one side of the head 3, there is integrally formed a neck (or hosel) 7 to which is connected the clubshaft 1.

A grounding edge 8, at which the head 3 grounds at first when the No. 3 iron is swung, is formed in the shape of a ridge on the sole 5 of the head 3. The grounding edge 8 is located in the position of about 2/9 of a sole width $W_1$ from the (not-numbered) leading edge of the face 4, extending longitudinally on the sole 5.

Figure 1B:
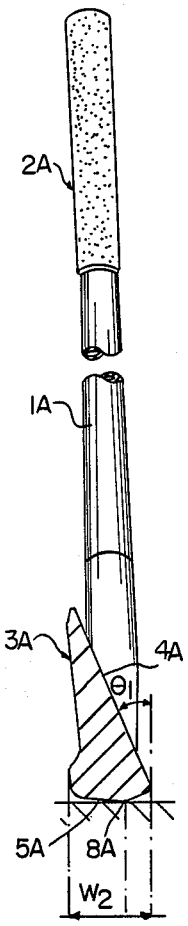
Figure 1C:
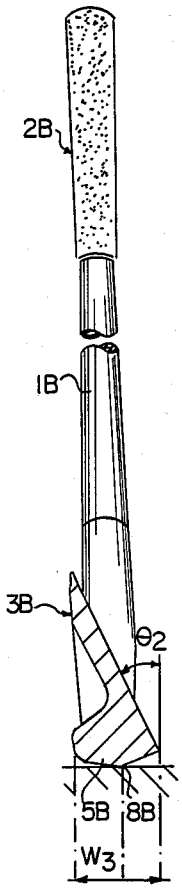
Figure 1D:
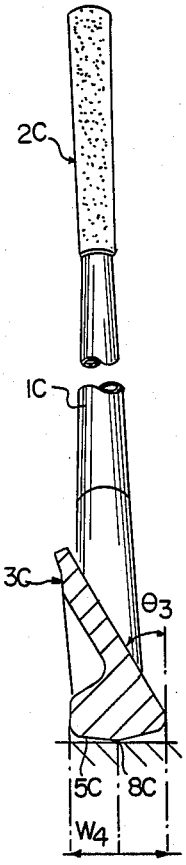
Figure 1E:
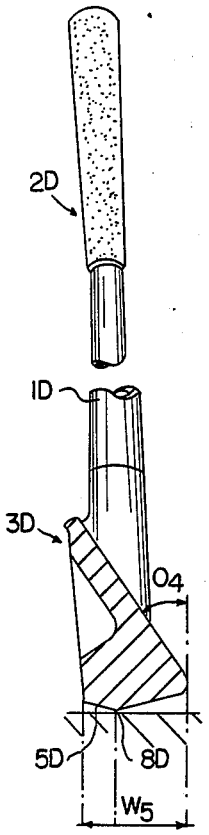
Figure 1F:
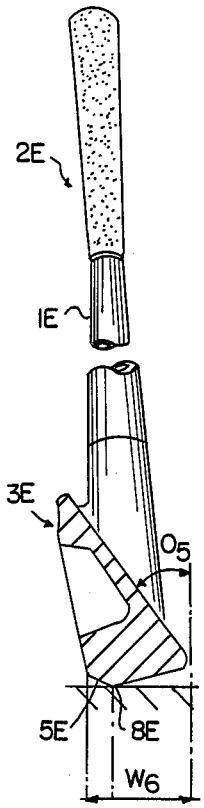

In the head 3A of a No. 4 iron 2A equipped with a shaft 1A having predetermined length and loft angle $\theta_1$, as shown in FIG. 1(B), the grounding edge 8A is formed in the position of about 3/9 of the width $W_2$ of a sole 5A from the leading edge of a face 4A.

Likewise, in the heads 3B, 3C, 3D and 3E equipped with shafts 1B, 1C, 1D and 1E having predetermined lengths and loft angles $\theta_2$, $\theta_3$, $\theta_4$ and $\theta_5$, as shown in FIGS. 1(C) to 1(F), respectively, the grounding edges 8B, 8C, 8D and 8E are formed in the respective positions of about 4/9, 5/9, 6/9 and 7/9 of the widths $W_3$, $W_4$, $W_5$ and $W_6$ of soles 5B, 5C, 5D and 5E.

Figure 1G:
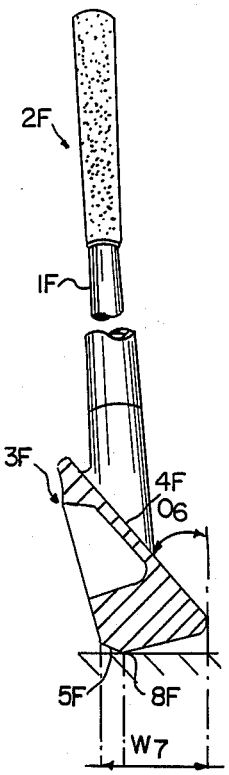

In the head 3F of a No. 9 iron 2F equipped with a short shaft 1F having a loft angle $\theta_6$, as shown in FIG. 1(G), the grounding edge 8F is formed in the position of about 8/9 of the width $W_7$ of a sole 5F.

Figure 2A:
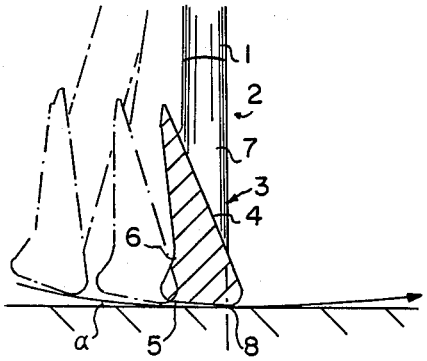
FIGS. 2(A) and 2(B) are sections showing the used states of the Nos. 3 and 9 irons, respectively.
Figure 2B:
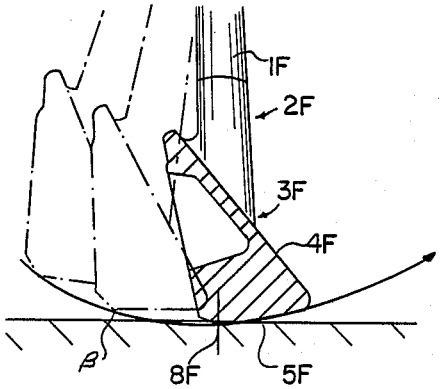
Figure 3A:
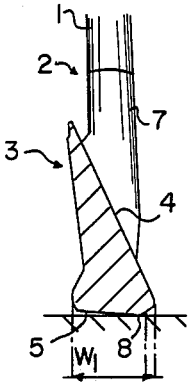
FIGS. 3(A) to 3(G) are sections showing Nos. 3 to 9 irons according to a second embodiment.
Figure 3B:
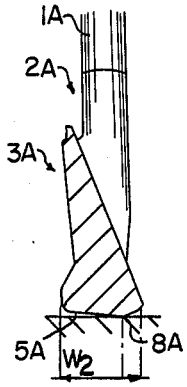
Figure 3C:
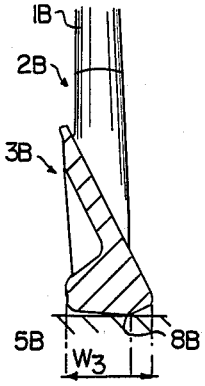
Figure 3D:
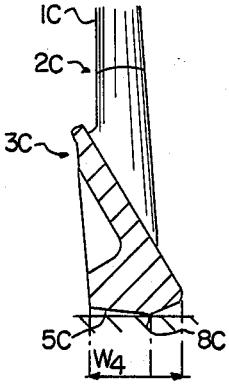
Figure 3E:
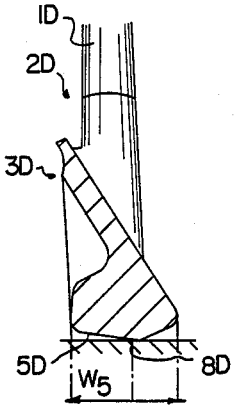
Figure 3F:
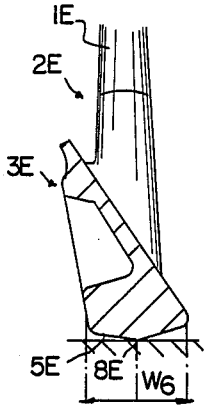
Figure 3G:
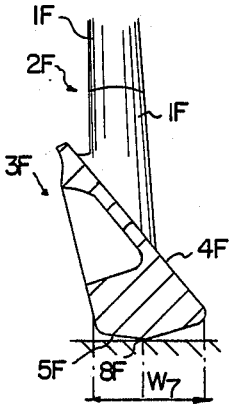

Thus, in case the No. 3 iron 2 having the long shaft 1 is swung, as shown in FIG. 2(A), i.e., in the case of a small angle of incidence $\alpha$ with respect to ground surface, the grounding edge 8 is located at a closer or leading side to the face 4 so that the swing can be made to hit the ball (not shown) away. Moreover, the face 4 has its lower edge positioned at a lower position so that it can confront the ball accurately when the iron 2 is swung to hit up the ball. In case, on the other hand, the No. 9 iron 2F having the short shaft 1F is swung, as shown in FIG. 2(B), i.e., in the case of a large angle of incidence $\beta$ with respect to the ground surface, the grounding edge 8F is located at a farther or trailing side from the face 4F so that the swing can be made with less drag. With the grounding edge 8F being swept back, specifically, the reaction obtainable from the ground when the ball is hit down is so high that the head 3F can hit through the ball while receiving an upward reaction from the ground.

As described above, the grounding edge 8 of the No. 3 iron 2 having the longer shaft 1 is positioned closer to the face 4 so that the face 4 can have its lower edge displaced closer tc the ground to confront the ball accurately. Thus, it is possible to provide the No. 3 iron 2 which can be easily swung to hit up the ball. On the other hand, the grounding edge 8F of the No. 9 iron 2F having the shorter shaft 1F is swept back apart from the face 4F so that the upward reaction obtainable when the ball is hit down is high. Thus, it is possible to provide the No. 9 iron 2F which can be swung to hit through the ball. In addition, the Nos. 4 to 8 irons 2A, 2B, 2C, 2D and 2E are also allowed to exhibit graduated performances between the Nos. 3 and 9 irons 2 and 2F.

FIG. 3 shows a second embodiment of the present invention, in which the same portions as those of the foregoing first embodiment are designated at the common reference characters while omitting their descriptions. As shown in FIG. 3(A), the grounding edge 8 of the No. 3 iron 2 having the long shaft 1 is located in the position of about 0.1 $W_1$ of the sole width $W_1$ from the leading edge of the face 4. Likewise, as shown in FIGS. 3(B) to 3(E), respectively, the grounding edges 8A, 8B, 8C, 8D and 8E of the Nos. 4 to 8 irons 2A, 2B, 2C, 2D and 2E are located in the respective positions of about 0.19 $W_2$, 0.272 $W_3$, 0.344 $W_4$, 0.410 $W_5$ and 0.469 $W_6$ of the sole widths $W_2$, $W_3$, $W_4$, $W_5$ and $W_6$.

Moreover, the grounding edge 8F of the No. 9 iron 2F having the short shaft 1F is located in the position of about 0.522 $W_7$ of the sole width $W_7$ from leading edge of the face 8F.

Thus, the Nos. 3 to 9 irons 2, 2A, 2B, 2C, 2D, 2E and 2F have their respective grounding edges 8, 8A, 8B, 8C, 8D, 8E and 8F located in a geometric progression. With these locations, the No. 3 iron 2 having the longest shaft 1 has its grounding edge 8 displaced closer to the face 4 so that its face 4 can become liable to confront the ball accurately. On the other hand, the No. 9 iron 2F having the shortest shaft 1F has its grounding edge 8F swept back to hit through the ball.

Figure 4:
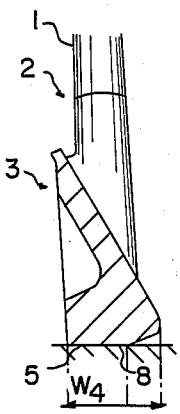
FIG. 4 is a section showing a third embodiment.

Turning to FIG. 4 showing a third embodiment of the present invention, the golf club 2 is modified to establish no slope on the sole 5 at the back side of the grounding edge 8.

Incidentally, the present invention should not be limited to the embodiments thus far described but can be modified in various manners. For example, the grounding edges of the clubheads may be swept back by 1 mm. Moreover, the heads may be made of not only steel or wood but also an aluminum or titanium alloy. In the heads, still moreover, there may be combined face members and back members having larger specific gravities than those of the former.

What is claimed is:

1. A set of golf clubs, each comprising:

a shaft, a head with a loft angle, and a sole with a ridge which extends longitudinally in the direction of heel to toe, is located intermediate the rear of the club head and the frontmost point of the striking face at the bottom of the club head, and projects outwardly from the plane of the sole;

the loft angle of each club head decreasing inversely relative to the other clubs in proportion to the length of its respective shaft;

and the ridge of each club being located back from the leading edge of the sole a distance, relative to the other clubs, inversely proportional to the length of its respective shaft.

2. A set of golf clubs according to claim 1, wherein said ridges are located back from the leading edge of the heads a distance which follows an arithmetic progression.

3. A set of golf clubs according to claim 1, wherein said ridges are located back from the leading edge of the heads a distance which follows a geometric progression.

* * * * *